US005765289A

United States Patent [19]

Schulz et al.

[11] Patent Number: 5,765,289

[45] Date of Patent: Jun. 16, 1998

[54] ROTARY CUTTER

[75] Inventors: William J. Schulz, Mosinee; Robert W. Cornell, Schofield, both of Wis.

[73] Assignee: Fiskars Inc., Madison, Wis.

[21] Appl. No.: 771,167

[22] Filed: Dec. 20, 1996

[51] Int. Cl.[6] ..... B26B 25/00

[52] U.S. Cl. ..... 30/319; 30/292

[58] Field of Search ..... 30/292, 306, 307, 30/319, 294, 286

[56] References Cited

U.S. PATENT DOCUMENTS

| | | | |
|---|---|---|---|
| 1,321,215 | 11/1919 | Kollar | 30/319 |
| 1,358,973 | 11/1920 | Minarick | 30/307 |
| 2,695,447 | 11/1954 | Maynard | 30/2 |
| 3,673,687 | 7/1972 | Phillips et al. | 30/294 |
| 3,802,080 | 4/1974 | Peter | 30/292 |
| 4,020,550 | 5/1977 | Okada | 30/292 |
| 4,301,594 | 11/1981 | Okada | 30/292 |
| 4,432,137 | 2/1984 | Okada | 30/292 |
| 4,601,103 | 7/1986 | Sugiyama | 30/292 |
| 4,809,437 | 3/1989 | Saliaris | 30/319 |
| 5,101,564 | 4/1992 | Melter | 30/319 |
| 5,144,749 | 9/1992 | Chen | 30/319 |
| 5,299,355 | 4/1994 | Boda et al. | 30/292 |
| 5,355,588 | 10/1994 | Brandenburg, Jr. et al. | 30/319 |

*Primary Examiner*—Hwei-Siu Payer
*Attorney, Agent, or Firm*—Foley & Lardner

[57] ABSTRACT

A rotary cutter includes an elongated handle having a gripping portion connected to a platform having a peripheral edge. A generally circular blade is rotatably mounted on a shaft extending through an aperture formed in the platform. The cutter also includes a blade guard having an arcuate portion. The guard is rotatable by the user to expose the cutting edge of the blade prior to using the cutter.

33 Claims, 4 Drawing Sheets

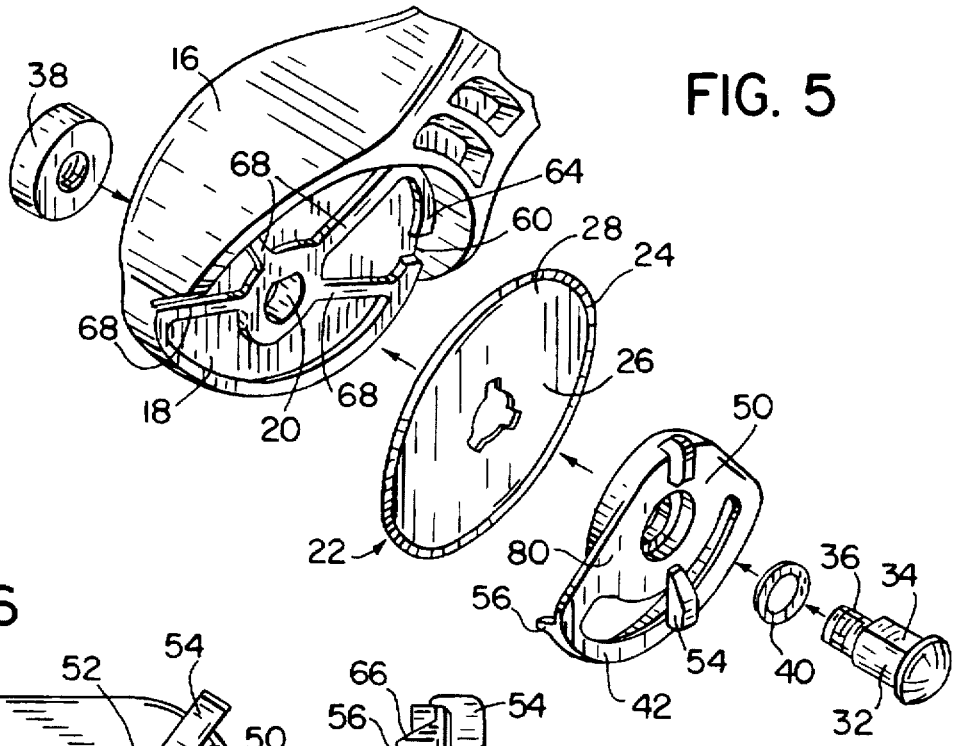
FIG. 5
FIG. 6
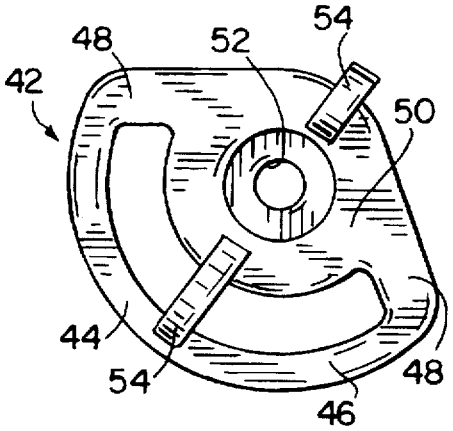
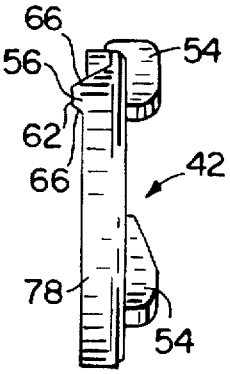
FIG. 7
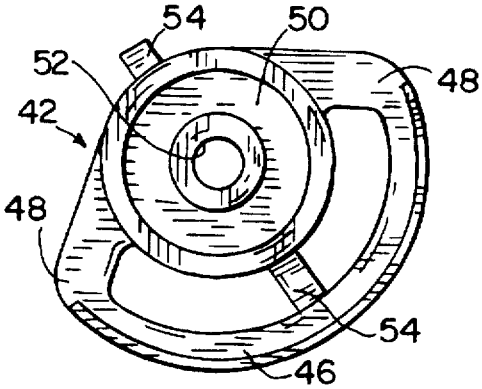
FIG. 8
FIG. 9
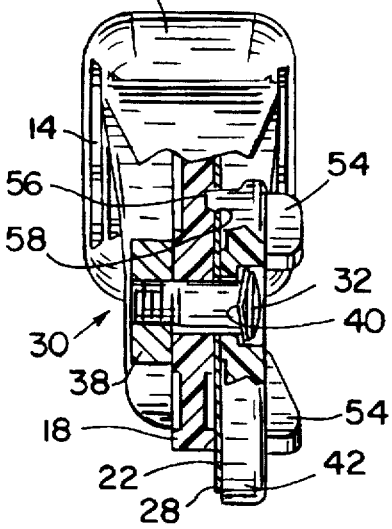

ROTARY CUTTER

FIELD OF THE INVENTION

The present invention relates generally to cutting tools, and more particularly, to a hand-held cutting tool having a rotatable circular blade.

BACKGROUND OF THE INVENTION

Hand-held rotary cutters are well known. Such items are commonly used to cut layers of fabric, cardboard, paper, or other materials. They typically include a body comprising a handle to be gripped by the user, the handle terminating in a generally circular head having a planar surface to which the circular blade is attached. A prior art cutter of this type is shown in U.S. Pat. No. 4,432,137 issued on Feb. 21, 1984 to Okada. As more particularly illustrated in FIGS. 1 and 2 of Okada, the rotary cutter has an elongated handle provided with an aperture formed through one of its ends in a direction perpendicular to the handle longitudinal axis. The cutter also includes a shaft extending through the aperture to support a disc-shaped blade rotatably mounted thereon.

For obvious reasons it is desirable to protect the cutting edge of the blade of a rotary cutter when not in use. Those skilled in the art have already attempted to do so in a number of ways. U.S. Pat. Nos. 5,101,564 issued on Apr. 7, 1992 to Melter, 5,299,355 issued on Apr. 5, 1994 to Boda et al., and 5,355,588 issued on Oct. 18, 1994 to Brandenburg et al., disclose various rotary cutters in which the blade is extendable relative to the handle so that it can be conveniently retracted within the confines of a circular head when the cutter is not in use. It should be noted that in a rotary cutter as disclosed in Brandenburg et al. (the '588 patent being incorporated herein by reference), the cutter can interchangeably use circular blades configured as a flat disc, or "formed" circular blades designed to cut the material along a particular pattern, such as a pinking pattern or the like. Necessarily, a formed blade will have a central region lying in a plane which will be offset from the plane of the cutting edge.

Instead of the cutter having a retractable blade, as shown in U.S. Pat. No. 4,301,594 issued on Nov. 24, 1991 to Okada, the blade can be fixedly mounted in translation relative to the handle, and a guide may then be extended in the region of the cutting edge of the blade to shield it when the cutter is not in use. In Okada, guard disc 14 which has a generally circular portion with a diameter larger than that of blade 13, is associated with a sliding portion 21. Guard disc 14 is slidable longitudinally, beneath the blade surface, between an extended position in which blade 13 is concealed behind guard disc 14 and a retracted position in which the peripheral edge of the blade is exposed. However, as one will readily appreciate, a slidable blade guard of the type disclosed in Okada cannot conveniently be used with formed blades because a portion of the cutting edge will typically remain fairly exposed.

While these prior art forms of protection of the cutting edge of the blade of a rotary cutter appear satisfactory, it has become apparent to the inventors of the present invention that it is desirable to fulfill the protective function in a more versatile and relatively inexpensive manner to avoid unduly increasing the cost of these cutters.

SUMMARY OF THE INVENTION

The rotary cutter in accordance with the present invention includes a handle provided with a gripping portion merging into a head configured as a platform having a peripheral edge. According to one aspect of the invention, the cutter includes a guard rotatable relative to the platform to expose the cutting edge of the blade when desired.

According to another aspect of the invention, the guard includes a tab and the platform includes a pair of recesses configured to cooperate with the tab to temporarily establish relative angular position of the guard and platform so that the arcuate portion of the guard extends beyond the cutting edge of the blade to shield the cutting edge of the blade when the cutter is not being used, the guard being maintained in position relative to the platform during normal use of the cutter.

According to yet another aspect of the invention the platform is configured so that the cutter is ambidextrous thereby permitting a user to activate the guard with either hand with equal facility, and the guard includes a lip which is particularly useful to shield the cutting edge of formed blades.

According to a further aspect of the invention, the guard is made of a resilient material and the tab is configured to facilitate the user's rotation of the guard from the established positions. This cutter also provides a method of cutting material by selectively rotating a blade guard to expose or shield the blade as desired.

BRIEF DESCRIPTION OF THE DRAWINGS

The preferred exemplary embodiment of the present invention will hereinafter be described in conjunction with the appended drawings, wherein like numerals denote like elements and:

FIG. 5 is a partial exploded view of the cutter shown in FIG. 1;

FIG. 6 is a front elevational view of the guard of the present invention;

FIG. 7 is a left side elevational view of the guard shown in FIG. 6;

FIG. 8 is a rear elevational view of the guard shown in FIG. 6;

FIG. 9 is a left side elevational view of the cutter of FIG. 1, partially in cross-section;

DETAILED DESCRIPTION OF A PREFERRED EXEMPLARY EMBODIMENT

Figure 1:
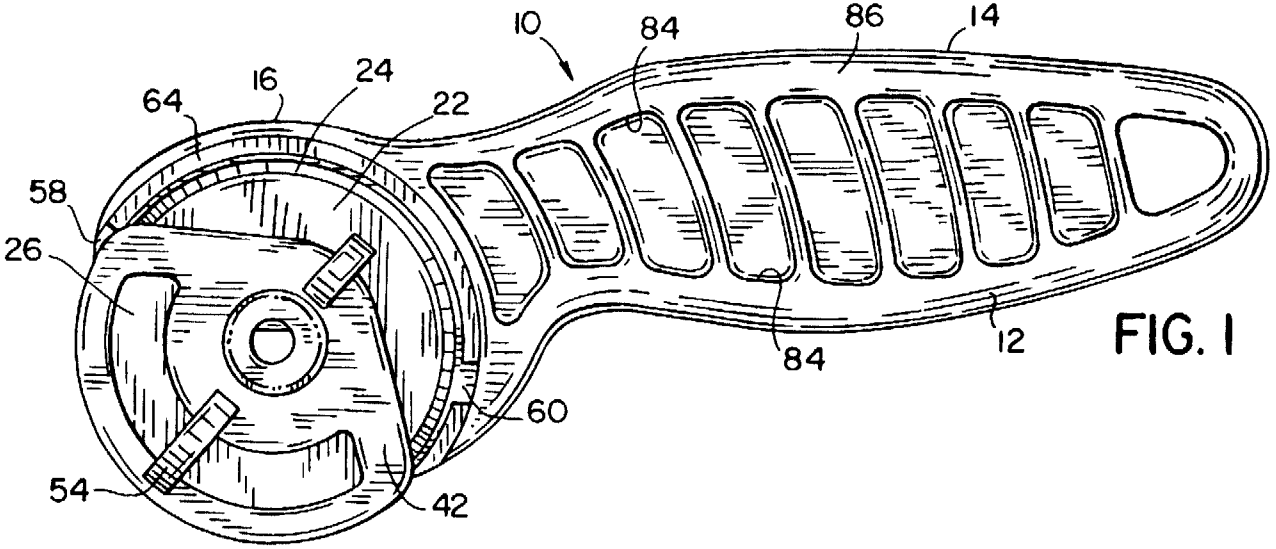
FIG. 1 is a front elevational view of a rotary cutter according to the present invention showing the cutting edge of the blade shielded by the guard.
Figure 2:
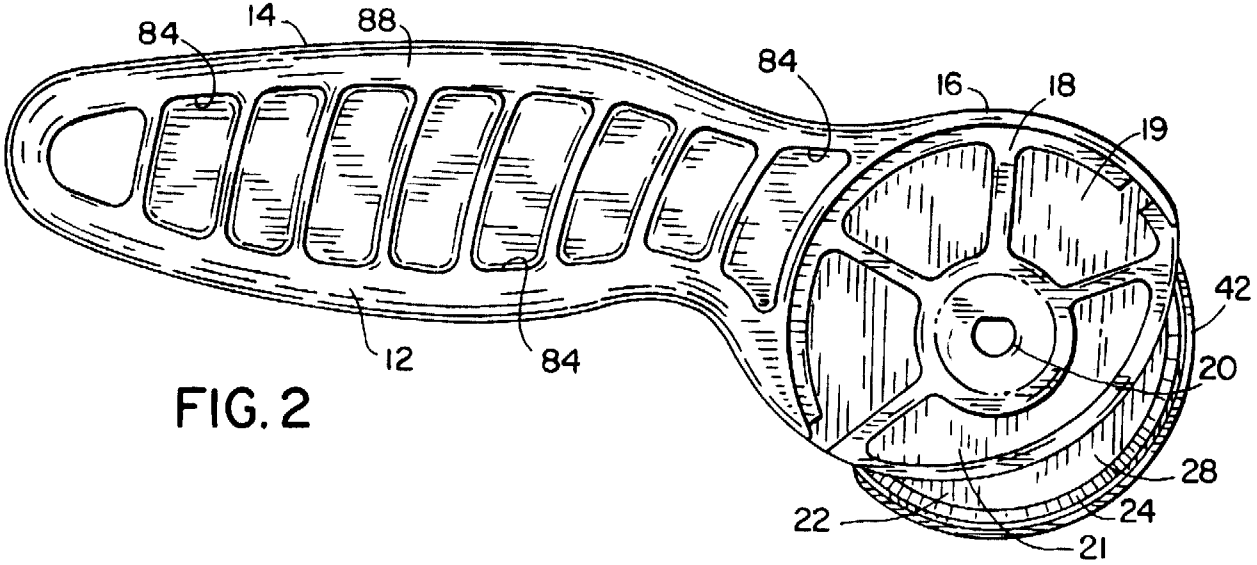
FIG. 2 is a rear elevational view thereof.

The present invention relates to hand-held rotary cutters of the type having a handle and associated circular cutting blade. It will become apparent from the following description that the features of the present invention may be utilized in rotary cutters for application to specific uses, such as for trimming, perforating, or performing other cutting operations on materials of various kinds, or for creating decorative edges using a blade having a formed customized edge. However, for ease of understanding and convenience the following description will from time to time simply refer to a hand-held cutter provided with a flat cutting disc. Nevertheless, skilled artisans will readily recognize its many other applications.

Referring to the Figures, a rotary cutter in accordance with the present invention, designated generally as 10, includes an elongated handle 12 having a gripping portion 14 connected to a head 16. Since, preferably, cutter 10 is made of a polymer or co-polymer material, gripping portion 14 merges into head 16. Head 16 is configured as a platform 18 provided with an aperture 20 formed therethrough. As illustrated in the Figures, platform 18 is advantageously formed of a semi-circular region 19 and an arcuate region 21.

Cutter 10 includes a blade 22 formed as a disc with a peripheral cutting edge 24, blade 22 having oppositely facing faces 26, 28. As more particularly shown in FIG. 5, blade 22 is rotatably mounted on cutter 10 by conventional connecting means generally designated as 30, with face 28 disposed facing platform 18. Conveniently, connecting means 30 includes a headed shaft 32 having a flat portion 34 formed thereon to prevent rotation of shaft 32 relative to platform 18. Shaft 32 has a threaded portion 36 engaging a fastener in the form of a retainer nut 38 disposed on the opposite side of cutter 10. Advantageously, connecting means 30 also includes a resilient washer 40 to prevent undesirable loosening of connecting means 30 by rotation of blade 22 during normal use of cutter 10. Those skilled in the art will recognize that connecting means 30 may take other forms, such as for example a bolt of another configuration, a threaded shaft, or another structure capable of rotatably mounting blade 22 onto head 16.

Cutter 10 also includes a guard 42 which is rotatable on shaft 32 so that it can be angularly positioned relative to platform 18, and accordingly relative to blade 22. Guard 42 includes an arcuate portion 44 advantageously configured as a band 46 extending between two arms 48 connecting band 46 to a central region 50. Central region 50 includes a central hole 52 through which shaft 32 passes. To facilitate rotation of guard 42 by a user, guard 42 also includes engaging portions 54 in this case in the form of ridges. Alternatively, engaging portions may be configured as recessed regions formed in the surface of guard 42.

Figure 3:
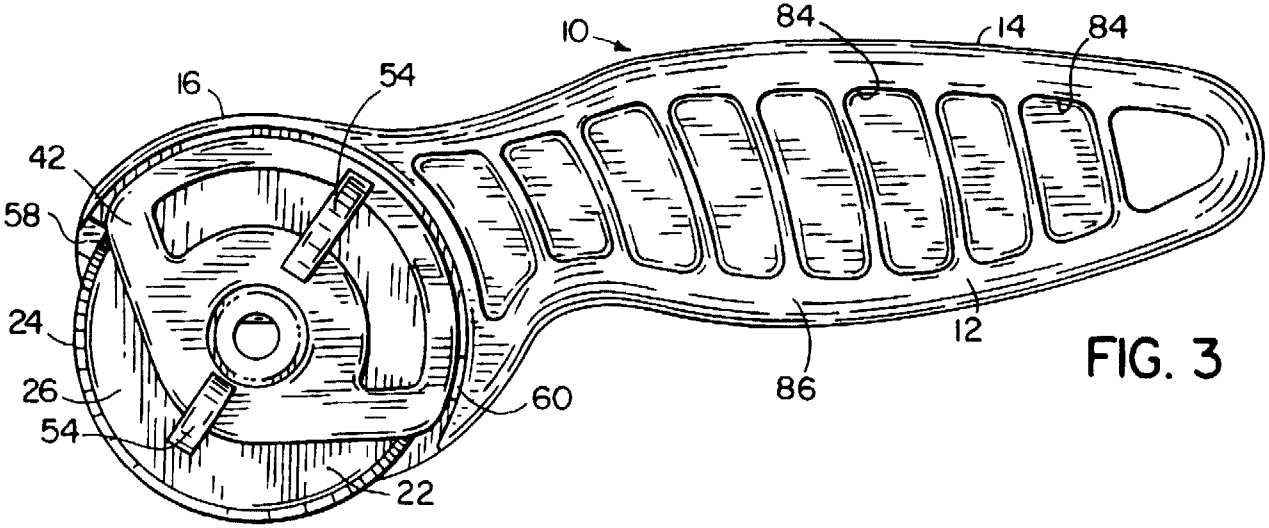
FIG. 3 is a front elevational view of the rotary cutter according to the present invention showing the guard rotated to expose the cutting edge of the blade.
Figure 4:
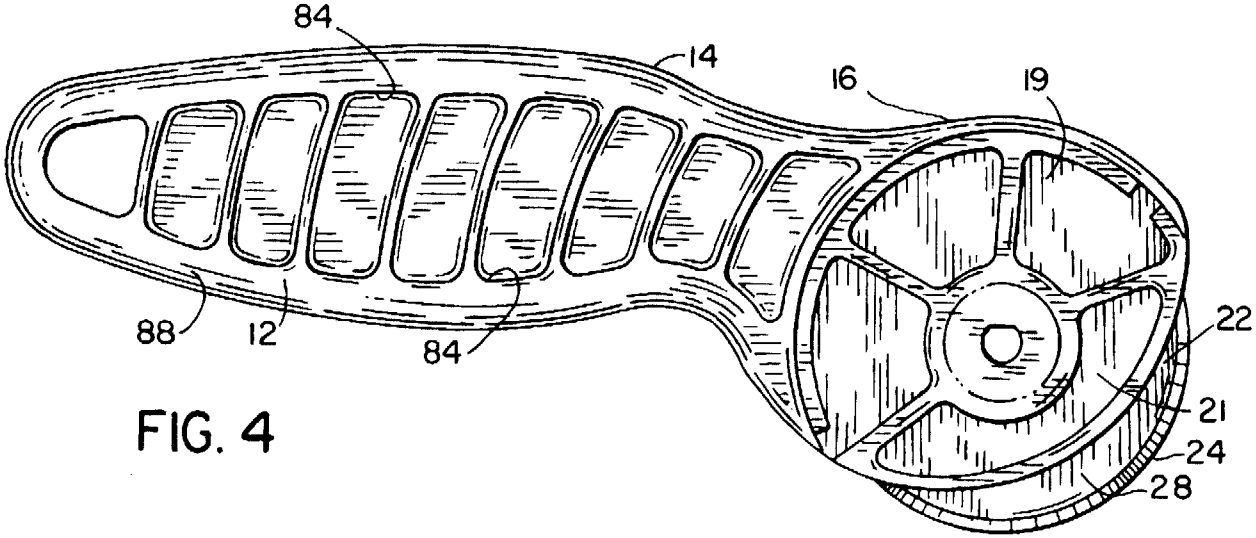
FIG. 4 is a rear elevational view of the cutter shown in FIG. 3.
Figure 12:
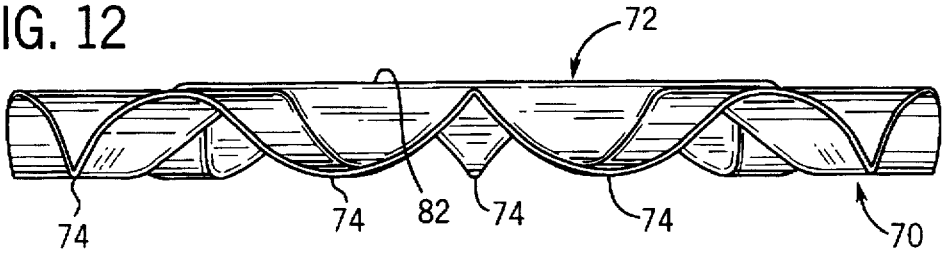
FIG. 12 is a top plan view of the blade shown in FIG. 10.
Figure 10:
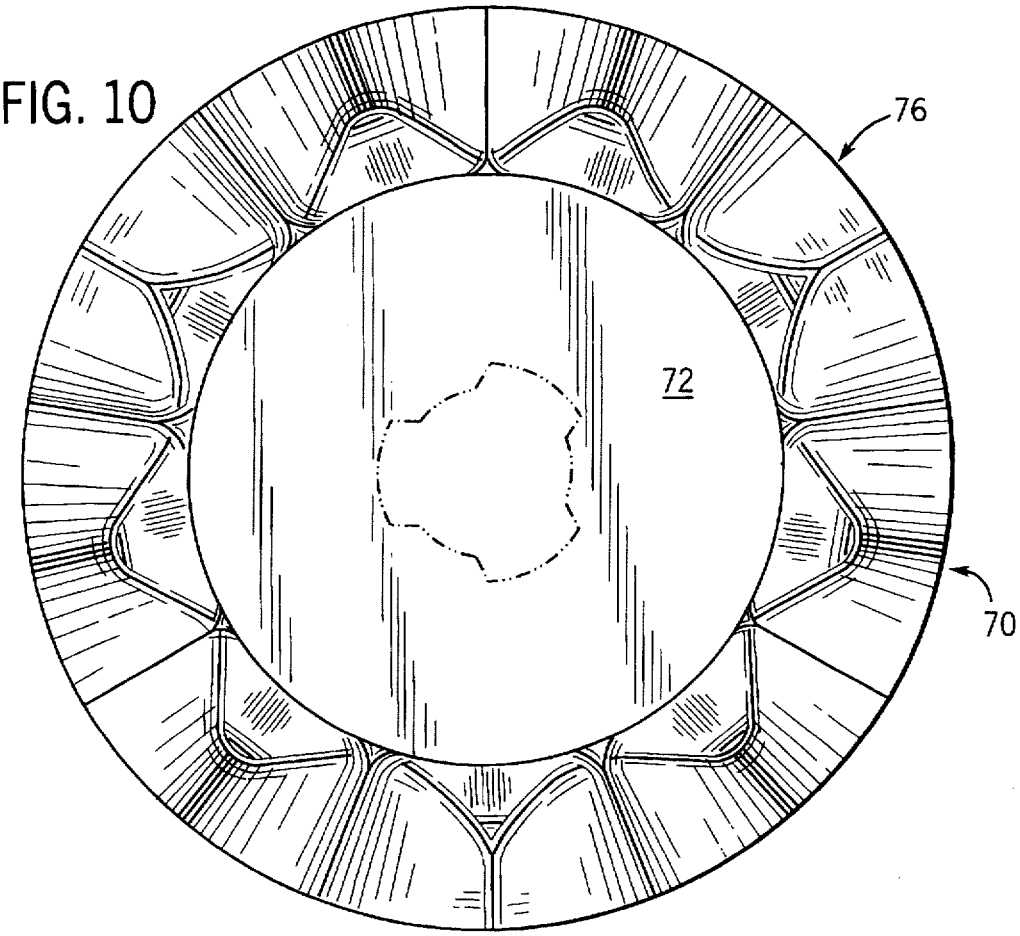
FIG. 10 is a front elevational view of a formed blade for use with the cutter shown in FIG. 1.
Figure 11:
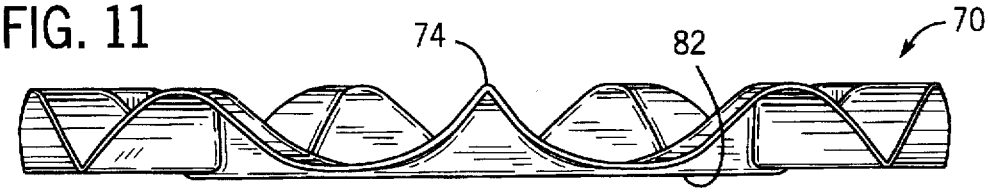
FIG. 11 is a bottom plan view of the blade shown in FIG. 10.

Guard 42 also includes a tab 56 releasably engaging in one of two selectable positions recesses 58 or 60 formed in platform 18. As illustrated in FIGS. 1 and 9, when tab 56 engages recess 58, arcuate portion 44 extends beyond cutting edge 24 to protect the user from engaging the lower region thereof when the cutter is not in use. Conversely and as illustrated in FIG. 3, by rotating guard 42 until tab 56 releasably engages recess 60, cutting edge 24 becomes exposed thereby allowing the user to operate cutter 10 as desired.

Guard 42 is preferably made of a resilient or otherwise deformable material such as a flowable polymer, copolymer or the like to allow formation of guard 42 by injection molding. As shown in FIGS. 1 and 5, clockwise rotation of guard 42 about shaft 32 from the non-use position (i.e., when the user wishes to disengage tab 56 from recess 58), causes arms 48 to deflect as tip 62 "climbs" out of recess 58. Tip 62 of tab 56 then rides on a track 64 raised around the inner portion of platform 18 exposing a progressively greater angular portion of cutting edge 24. When tab 56 snaps into recess 60 it establishes a first position of guard 42 relative to platform 18 which corresponds to the "use" position of cutter 10. Alternatively, tab 56 may be disengaged from recess 58 by counterclockwise rotation of guard 42 until tab 56 engages recess 60. In that case, tip 62 will not be in contact with any portion of platform 18 until tab 56 reaches a region proximate recess 60. Since by clockwise or counterclockwise rotation of guard 42 tip 62 snaps into recess 60, guard 42 will retain its position relative to platform 18 during normal use of cutter 10.

Conversely, the user may shield cutting edge 24 by clockwise or counterclockwise rotation of guard 42. In either of these two cases, tab 56 will climb out of recess 60 until tab 56 snaps back into recess 58, thereby establishing a second position corresponding to the "non-use" of cutter 10.

To facilitate rotation of guard 42 when desired by the user without, however, impairing the ability of the guard to reliably retain the first or second position, tab 56 includes angled faces 66. As can be readily appreciated, angled faces 66 allow tab 56 to more easily climb out of recesses 58, 60. In addition and advantageously, central region 50 of guard 42 may be recessed thereby further facilitating rotation of guard 42 once tab 56 is no longer in recesses 58, 60. Similarly, platform 18 may also include a plurality of raised ribs 68 radiating from a region proximate aperture 20 to track 64. As a result, face 28 of blade 22 will be in contact with the raised regions only of platform 18 which include ribs 68 and the region proximate aperture 20.

In addition and as shown in the Figures, cutter 10 further departs from prior art cutters in that it is essentially symmetrical. In particular, both sides of platform 18 are substantially identical to allow blade 22 and guard 42 to be attached to head 16 on either side thereof. Accordingly, cutter 10 is ambidextrous thereby permitting a user to activate guard 42 with either hand with equal facility.

Furthermore, guard 42 is also configured to more effectively shield the cutting edge of formed blades of the type illustrated in FIGS. 10–13. As shown in these Figures, formed blade 70 includes a central hub 72 lying in a plane which is offset from a plane passing through the peaks 74 forming part of decorative cutting edge 76. Toward that end, guard 42 includes a lip 78 which is preferably disposed at right angle with the outer surface 80 of guard 42. As a result, when blade 70 is mounted onto head 16 with the bottom face 82 against ribs 68 of platform 18 and when guard 42 is rotated to the non-use position, lip 78 essentially shields cutting edge 76 from bottom face 82 to peaks 74.

Finally, gripping portion 14 of handle 12 may include a plurality of cavities generally designated as 84. Cavities 84 may be formed in oppositely facing sides 86, 88 of handle 12. Cavities 84 advantageously prevent slippage or otherwise increase user comfort.

It is understood that the above description is of a preferred exemplary embodiment of the present invention, and that the invention is not limited to the specific forms described. For example, while in accordance with the invention the blade guard is rotatable relative to the blade to shield or expose as desired a portion of the cutting edge, it should be recognized that the configuration of the guard as herein described, while presently found preferable, is not necessarily required, so long as it may be rotated and selectively positioned relative to the blade. Moreover, it may be desirable for a variety of reasons such as manufacturing considerations to change the configuration of tab 56 and recesses 58, 60, or to adopt a connecting means of a type other than connecting means 30.

It should be understood, however, that these and other substitutions, modifications, changes and omissions may be made in the design and arrangement of the elements disclosed herein without departing from the scope of the appended claims.

We claim:

1. A rotary cutter comprising:

an elongated handle having a gripping portion merging into a head configured as a platform, the platform having an aperture formed therethrough;

a generally circular blade having a cutting edge, the blade being rotatably mounted on a shaft extending through the aperture, the shaft being associated with a fastener to secure the blade to the handle while permitting rotation of the blade relative thereto, the cutting edge projecting from the head by a predetermined distance; and a guard selectively rotatable on the shaft, the guard being made of a resilient material and having a band forming an arcuate portion, the arcuate portion extending beyond the cutting edge when the rotary cutter is not in use, the band being spaced from a central region of the guard but joined thereto by at least two arms extending therebetween.

2. The cutter of claim 1, wherein the guard further includes at least one engaging portion to facilitate rotation of the guard relative to the platform.

3. The cutter of claim 2, wherein the at least one engaging portion is a ridge connecting the band to the central region.

4. A rotary cutter comprising:

an elongated handle having a gripping portion merging into a head configured as a platform, the platform having an aperture formed therethrough;

a generally circular blade having a cutting edge, the blade being rotatably mounted on a shaft extending through the aperture, the shaft being associated with a fastener to secure the blade to the handle while permitting rotation of the blade relative thereto, the cutting edge projecting from the head by a predetermined distance; and a guard selectively rotatable on the shaft, the guard being made of a resilient material and having an arcuate portion extending beyond the cutting edge when the rotary cutter is not in use, wherein the guard and the platform further include at least one of a tab and a recess to establish at least one position of the guard relative to the platform.

5. A rotary cutter comprising:

an elongated handle having a gripping portion merging into a head configured as a platform, the platform having an aperture formed therethrough;

a generally circular blade having a cutting edge, the blade being rotatably mounted on a shaft extending through the aperture, the shaft being associated with a fastener to secure the blade to the handle while permitting rotation of the blade relative thereto, the cutting edge projecting from the head by a predetermined distance; and a guard selectively rotatable on the shaft, the guard having an arcuate portion extending beyond the cutting edge when the rotary cutter is not in use and at least one ridge to facilitate rotation thereof by a user.

6. The cutter of claim 5, wherein the platform has two substantially vertical walls, the blade being disposed between the guard and an exterior of one of the walls.

7. A rotary cutter comprising:

an elongated handle having a gripping portion merging into a head configured as a platform, the platform having an aperture formed therethrough;

a generally circular blade having a cutting edge, the blade being rotatably mounted on a shaft extending through the aperture, the shaft being associated with a fastener to secure the blade to the handle while permitting rotation of the blade relative thereto, the cutting edge projecting from the head by a predetermined distance; and a guard selectively rotatable on the shaft, the guard having an arcuate portion extending beyond the cutting edge when the rotary cutter is not in use, the arcuate portion formed as a lip extending from an outer surface of the guard by a predetermined distance.

8. The cutter of claim 7, wherein the blade comprises a centrally located hub having a bottom surface, the bottom surface being offset from the cutting edge configured to cut along a decorative line, the predetermined distance being substantially equal to a distance separating the bottom surface from peak regions of the cutting edge.

9. A rotary cutter comprising:

an elongated handle having a gripping portion merging into a head configured as a platform having a peripheral edge, the platform having two substantially vertical walls and an aperture formed therethrough;

a generally circular blade having a cutting edge, the blade being rotatably mounted on a shaft extending through the aperture and disposed adjacent an exterior of one of the walls, the shaft being associated with a fastener to secure the blade to the handle while permitting rotation of the blade relative thereto, the cutting edge projecting from the peripheral edge by a predetermined distance; and a guard selectively rotatable on the shaft, the guard having an arcuate portion extending beyond the cutting edge when the rotary cutter is not in use.

10. The cutter of claim 9, wherein the guard is made of a resilient material.

11. The cutter of claim 10, wherein the resilient material is a plastic.

12. The cutter of claim 10, wherein the guard further comprises at least one tab and the platform further comprises at least one recess configured to cooperate with the at least one tab to temporarily establish relative angular position of the guard and platform in the storage position.

13. The cutter of claim 12, wherein the platform includes a track on which a portion of the at least one tab rides during rotation of the guard.

14. The cutter of claim 12, wherein the at least one tab is configured to facilitate rotation of the guard from the established angular position.

15. The cutter of claim 10, wherein the guard includes a band forming the arcuate portion, the band being spaced from a central region of the guard but joined thereto by at least two arms extending therebetween.

16. The cutter of claim 15, wherein the guard further comprises at least one engaging portion to facilitate rotation of the guard relative to the platform.

17. The cutter of claim 16, wherein the at least one engaging portion is a ridge connecting the band to the central region.

18. The cutter of claim 10, wherein the guard and platform further comprise at least one of a tab and a recess to establish at least one position of the guard relative to the platform.

19. The cutter of claim 9, wherein the guard further comprises at least one engaging portion to facilitate rotation thereof by a user.

20. The cutter of claim 19, wherein the at least one engaging portion is a ridge.

21. The cutter of claim 9, wherein the gripping portion includes a plurality of cavities formed in oppositely facing sides thereof.

22. The cutter of claim 9, wherein the platform includes a semi-circular region joined to an arcuate region.

23. The cutter of claim 9, wherein the platform is configured so that the blade and the guard can be rotatably attached on either side of the head thereby permitting a user to activate the guard with either hand with equal facility.

24. The cutter of claim 9, wherein the blade is a substantially flat disc.

25. The cutter of claim 9, wherein the blade is a formed blade comprising a centrally located hub having a bottom surface, the bottom surface being offset from the cutting edge, the cutting edge being configured to cut along a decorative line.

26. The cutter of claim 9, wherein the arcuate portion is formed as a lip extending from an outer surface of the guard by a predetermined distance.

27. The cutter of claim 26, wherein the blade comprises a centrally located hub having a bottom surface, the bottom surface being offset from the cutting edge configured to cut along a decorative line, the predetermined distance being substantially equal to a distance separating the bottom surface from peak regions of the cutting edge.

28. A rotary cutter comprising:

a handle having a gripping portion joined to a platform terminating along a peripheral edge, the platform having an aperture formed therethrough and a plurality of ribs radiating from a central region thereof, the plurality of ribs terminating in a distal region, the distal region configured as a track;

a circular blade having a cutting edge and oppositely facing first and second surfaces;

means for rotatably connecting the blade to the platform so that the cutting edge projects from the peripheral edge by a predetermined distance; and a guard selectively rotatable relative to the platform, the guard having an arcuate portion extending beyond the cutting edge when the rotary cutter is in storage position.

29. The cutter of claim 28, wherein the track includes a first recess spaced apart from a second recess, and the guard further comprises a tab selectively engaging the first and second recesses to temporarily position the guard relative to the platform in first and second positions, respectively.

30. A rotary cutter comprising:

an elongated handle having a gripping portion merging into a head configured as a platform, the platform having an aperture formed therethrough and at least one recess;

a generally circular blade having a cutting edge, the blade being rotatably mounted on a shaft extending through the aperture, the shaft being associated with a fastener to secure the blade to the handle while permitting rotation of the blade relative thereto, the cutting edge projecting from the head by a predetermined distance; and a guard selectively rotatable on the shaft, the guard being made of a resilient material and having an arcuate portion extending beyond the cutting edge when the rotary cutter is not in use and at least one tab configured to cooperate with the at least one recess to temporarily establish relative angular position of the guard and the platform in the storage position.

31. The cutter of claim 30, wherein the platform includes a track on which a portion of the at least one tab rides during rotation of the guard.

32. The cutter of claim 30, wherein the at least one tab is configured to facilitate rotation of the guard from the established angular position.

33. A method of cutting paper, cardboard, or fabric using a cutter which cutter comprises:

a. an elongated handle having a gripping portion merging into a head configured as a platform having a peripheral edge, the platform having an aperture formed therethrough;

b. a generally circular blade having a cutting edge, the blade being rotatably mounted on a shaft extending through the aperture, the shaft being associated with a fastener to secure the blade to the handle while permitting rotation of the blade relative thereto, the cutting edge projecting from the peripheral edge by a predetermined distance; and c. a guard selectively rotatable on the shaft, the guard having an arcuate portion extending beyond the cutting edge when the rotary cutter is in storage position and at least one ridge to facilitate rotation thereof by a user, the method comprising:

engaging said at least one ridge to rotate the guard from the storage position to expose a portion of the cutting edge; and guiding the cutter over a surface of the material applying sufficient downward force on the blade to cut the material.

* * * * *